US009126225B2

(12) United States Patent
Yamada et al.

(10) Patent No.: US 9,126,225 B2
(45) Date of Patent: Sep. 8, 2015

(54) COATING APPARATUS AND COATING FILM MANUFACTURING METHOD

(71) Applicant: FUJIFILM Corporation, Tokyo (JP)

(72) Inventors: Takeo Yamada, Kanagawa (JP); Kazuya Kojima, Kanagawa (JP)

(73) Assignee: FUJIFILM CORPORATION, Tokyo (JP)

( * ) Notice: Subject to any disclaimer, the term of this patent is extended or adjusted under 35 U.S.C. 154(b) by 91 days.

(21) Appl. No.: 13/713,783

(22) Filed: Dec. 13, 2012

(65) Prior Publication Data

US 2013/0156965 A1 Jun. 20, 2013

(30) Foreign Application Priority Data

Dec. 16, 2011 (JP) ..... 2011-276068

(51) Int. Cl.
*B05C 5/02* (2006.01)
*B05D 1/26* (2006.01)
*B05C 11/10* (2006.01)

(52) U.S. Cl.
CPC ..... *B05C 5/0291* (2013.01); *B05C 5/0254* (2013.01); *B05C 11/1039* (2013.01); *B05D 1/26* (2013.01); *B05D 1/265* (2013.01)

(58) Field of Classification Search
CPC .. B05C 5/0291; B05C 11/1039; B05C 5/0254
USPC ..... 118/603, 126, 410–419, 50
See application file for complete search history.

(56) References Cited

U.S. PATENT DOCUMENTS 2,679,231 A * 5/1954 Pomper ..... 118/63
3,799,111 A * 3/1974 Damrau ..... 118/63
4,009,657 A * 3/1977 Bonanno et al. ..... 101/157

FOREIGN PATENT DOCUMENTS

JP 2003-181350 * 7/2003
JP 2004-141806 A 5/2004
JP 2007-283260 A 11/2007

* cited by examiner

*Primary Examiner* — Laura Edwards
(74) *Attorney, Agent, or Firm* — Jean C. Edwards, Esq.; Edwards Neils PLLC

(57) ABSTRACT

A coating apparatus includes a die coater that supplies a coating liquid to a web. The die coater includes a die main body, a manifold, a slot, a lip face, a mount, a decompression chamber, and a container. The container includes a guide plate guiding the coating liquid or a solvent ejected from the slot of the die coater without bringing the coating liquid or solvent into contact with the mount and the decompression chamber in a non-steady state, in which the coating liquid is not supplied from the die coater to the web. The container collects the coating liquid or the solvent guided by the guide plate. The coating apparatus also includes a liquid discharge tube that is connected to the container and discharges the coating liquid or solvent to an outside of the decompression chamber.

17 Claims, 10 Drawing Sheets

COATING APPARATUS AND COATING FILM MANUFACTURING METHOD

CROSS-REFERENCE TO RELATED APPLICATIONS

This application claims priority from Japanese Patent Application No. 2011-276068, filed on Dec. 16, 2011, the contents of which are herein incorporated by reference in their entirety.

BACKGROUND OF THE INVENTION

1. Field of the Invention

The present invention relates to a coating apparatus and a coated film manufacturing method.

2. Description of the Related Art

In the manufacturing of a coated film, for example, an optical film, a coating liquid is supplied to a continuously traveling web by a die coater. Generally, in a steady state, i.e., in a state in which the die coater and the web are brought into close contact with each other, coating is performed while forming a bead between a tip of the die coater and the web. An upstream side of the web is decompressed by a decompression chamber so as to continuously stabilize the bead.

In the coating using the die coater, so as to avoid trapping of air bubbles into a manifold of the die coater, a solvent is made to flow from the die coater in a non-steady state, i.e., in a state in which the die coater is detached from the web, that is, prior to the supply of the coating liquid from the die coater to the web. Then, switching from the solvent to the coating liquid is performed immediately before the steady state, i.e., the state in which the die coater and the web are brought into close contact with each other (JP2007-283260A).

During the coating by the die coater, when a joint portion at which the webs are jointed approaches the die coater, the die coater enters the non-steady state in which the die coater is retreated from the web, while ejecting the coating liquid. When the joint portion passes the die coater, the die coater returns the steady state in which the die coater approaches the web (JP2004-141806A).

SUMMARY OF THE INVENTION

In recent years, so as to realize a desired function, a technology of forming a coating film with a high degree of precision in a relatively thin wet film thickness is required. It is necessary for a clearance between the die coater and the web to be small and to precisely maintain the clearance so as to form the thin coating film with a high degree of precision.

However, even when positioning of the clearance is performed with a high degree of precision, there is a problem in that the degree of precision of the set clearance may not be maintained.

For example, in the non-steady state during the coating by the die coater, a liquid (a solvent and a coating liquid) that is ejected from the die coater flows to the decompression chamber. The liquid inside the decompression chamber is discharged to the outside, but part of the liquid is evaporated in the decompression chamber. The decompression chamber is thermally deformed due to evaporation latent heat. As a result of this deformation, the die coater may be deformed. On the other hand, in the steady state, the coating liquid ejected from the die coater is supplied to the web and does not flow to the decompression chamber. Therefore, the thermal deformation of the decompression chamber is gradually removed, the deformation of the die coater is also removed, and the die coater returns to the original shape. In addition to the decompression chamber, the same problem occurs in a case where the liquid adheres to a mount that supports the die coater in the non-steady state.

That is, when the liquid adheres to members making up a coating apparatus, the above-described thermal deformation is repetitively performed, and thus the clearance between the tip of the die coater and the web varies. As a result, it becomes difficult to perform the coating with a high degree of precision.

The present invention has been made in consideration of the above-described circumstances, and an object thereof is to provide a coating apparatus and a coated film manufacturing method, in which a variation in clearance between a tip of a die coater and a web due to an effect of evaporation latent heat of a coating liquid or a solvent is suppressed.

According to an aspect of the present invention, there is provided a coating apparatus including: a die coater that supplies a coating liquid to a web which is continuously travelling, the die coater including a die main body, a manifold formed in the die main body, a slot formed in the die main body and communicating with the manifold, a lip face formed in the die main body at a tip of the slot; a mount that supports the die coater; a decompression chamber that is disposed upstream of the die coater in a web conveyance direction; a container that includes a guide plate guiding the coating liquid or a solvent ejected from the slot of the die coater without bringing the coating liquid or solvent into contact with the mount and the decompression chamber in a non-steady state, in which the coating liquid is not supplied from the die coater to the web, the container collecting the coating liquid or the solvent guided by the guide plate; and a liquid discharge tube that is connected to the container and discharges the coating liquid or solvent to an outside of the decompression chamber.

Preferably, the container including the guide plate is integrally formed.

Preferably, when average rigidity is defined as an average value of {(thickness)×(Young's modulus)×(coefficient of thermal expansion)} in a width direction, the average rigidity of the container is 20,000 (N/(m·k)) or less.

Preferably, the container is disposed as being spaced apart from the mount and the decompression chamber by a distance of 0.5 mm or more.

Preferably, the container is attached to the die main body by first attachment units along a width direction of the web, and an average distance between the first attachment units and an lowest end portion of the container is 80 mm or more.

Preferably, the container is attached to the die main body through an elastic body.

Preferably, a caulking material is provided at an upper end of the container, the caulking material being configured to cover a gap between the container and the die main body.

Preferably, the first attachment units that are adjacent to each other are disposed to be spaced from each other at an interval of 30 mm or more.

Preferably, a groove or a convex portion is formed on a container attaching surface of the die main body, the groove or the convex portion being configured to guide the coating liquid or solvent ejected from the slot to the container.

Preferably, the container including the guide plate is configured by a guide plate member and a container member.

Preferably, the average rigidity of the container member is 20,000 (N/(m·k)) or less.

Preferably, the container member is disposed as being spaced apart from the mount and the decompression chamber by a distance of 0.5 mm or more.

Preferably, the guide plate member is attached to the die main body by second attachment units along a width direction of the web, the container member is attached to the decompression chamber by third attachment units along a width direction of the web, and an average distance between the third attachment units and the lowest end portion of the container member is 80 mm or more.

Preferably, the guide plate member is attached to the die main body through an elastic body.

Preferably, a caulking material is provided at an upper end of the container, the caulking material being configured to cover a gap between the guide plate member and the die main body.

Preferably, the third attachment units that are adjacent to each other are disposed to be spaced from each other at an interval of 30 mm or more, and the second attachment units that are adjacent to each other are disposed to be spaced from each other at an interval of 30 mm or more.

Preferably, the guide plate member and the container member are physically separated from each other or are coupled to each other at one place.

Preferably, a groove or a convex portion is formed on a container attaching surface of the die main body, the groove or the convex portion being configured to cover a gap between the guide plate member and the die main body.

Preferably, the lowest end of the guide plate member is located at a lower position compared to the third attachment units.

Preferably, the decompression chamber includes two sheets of arc-shaped side plates and a back plate that is connected to the two sheets of side plates, and a distance between the side plates and the lip face of the die coater is set to 0.1 mm or more.

According to another aspect of the present invention, there is provided a method of manufacturing a coated film by supplying a coating liquid to a web which is continuously traveling. The method includes: preparing the coating apparatus; causing the coating apparatus to stand by at a position at which a clearance between the coating apparatus and the web is larger than a predetermined clearance while the die coater is caused to eject a solvent, the predetermined clearance being a clearance which is kept between the coating apparatus and the web during coating; and forming a coating film by causing the die coater to eject the coating liquid switched from the solvent, moving the coating apparatus to a position at which the predetermined clearance is present between the coating apparatus and the web in a state in which the coating liquid is ejected, forming a bead between the web and the die coater, and supplying the coating liquid to the web Preferably, the method further includes moving the coating apparatus to so that the clearance between the coating apparatus and the web be larger than the predetermined clearance before a joint portion of the web passes a coating position; and moving the coating apparatus so that the clearance between the coating apparatus and the web be the predetermined clearance after the joint portion passes the coating portion.

According to the present invention, a variation in clearance between a tip of a die coater and a web due to evaporation latent heat of a coating liquid or a solvent may be suppressed.

DESCRIPTION OF THE PREFERRED EMBODIMENTS

Hereinafter, preferred embodiments of the present invention will be described with reference to the attached drawings. The invention will be described on the basis of the following preferred embodiments, but modifications may be made by a number of methods without departing from the scope of the invention, and other embodiments other than these embodiments may be used. Therefore, all of the modifications within the scope of the invention are included in the claims.

First Embodiment

Figure 1:
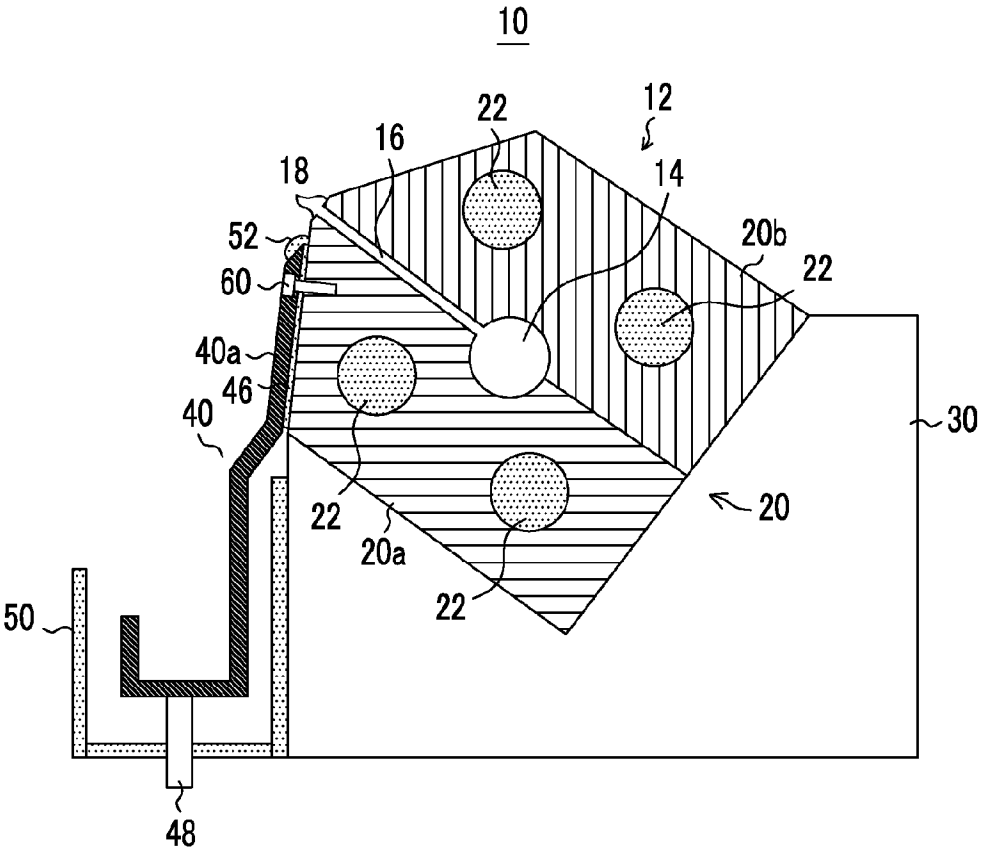
FIG. 1 is a schematic configuration diagram of a coating apparatus according to a first embodiment.

FIG. 1 shows a cross-sectional diagram of a coating apparatus. The coating apparatus 10 includes an extrusion-type die coater 12, a mount 30 that supports the die coater 12, a container 40 having a guide plate 40*a* attached to the die coater 12, and a decompression chamber 50 that is provided to be adjacent to the die coater 12. The coating apparatus 10 supplies a coating liquid to a continuously traveling web to form a coating film on the web.

In regard to positions, a direction in which the web is conveyed from an arbitrary reference point is called "to the downstream" or "the downstream side", and a direction that is opposite to the direction in which the web is conveyed from an arbitrary reference point is called "to the upstream" or "the upstream side". In addition, a direction of the web that is orthogonal to the web conveyance direction is called "a width direction of a web".

The die coater 12 includes a die main body 20 that is configured by two blocks of an upstream die block 20*a* and a downstream die block 20*b*. The die coater 12 includes a manifold 14 that is provided inside the main body, and a slot 16 that communicates with the manifold 14. A lip face 18 is formed on a tip side of the slot 16. In the extrusion-type die coater 12, a bead is formed between a coating liquid that is ejected from the slot 16 and the web, and thereby the coating liquid is supplied to the web. The manifold 14 and the slot 16 are formed by disposing the upstream die block 20*a* and the downstream die block 20*b*, in which a cavity is formed, to be opposite to each other. Because the die coater 12 is formed to have a multi-block structure in this way, a degree of processing precision of the die coater 12 may be increased. The upstream die block 20*a* and the downstream die block 20*b* are configured by a highly rigid material such as SUS. The reason why this material is used is because corrosion resistance is high or the degree of processing precision is high. Although an example in which the die main body is configured by the upstream die block 20*a* and the downstream die block 20*b* is described, the die main body 20 may be formed in an integral manner.

The manifold 14 of the die coater 12 is filled with the coating liquid so as to spread the coating liquid that is supplied in the coating width direction (the width direction of the web). For example, the manifold 14 of this embodiment has a cross-sectional shape of a circular shape, an elliptical shape, a semi-circular shape, an approximately semi-circular shape, a trapezoidal shape, or an approximately trapezoidal shape. The manifold 14 makes up a hollow portion having approximately the same cross-sectional shape along the width direction of the web.

The shape of the lip face 18 is appropriately selected according to conditions such as the kind of coating liquid, and the thickness of the coating film that is formed on the web. The shape and size of the lip face 18, and the like may be made to be different in the upstream die block 20*a* and the downstream die block 20*b*.

So as to prevent a temperature variation that becomes a cause of deformation of the die coater 12, a temperature control flow channel 22 is provided inside the upstream die block 20*a* and the downstream die block 20*b*. The temperature control of the die coater 12 is performed by circulating a temperature maintaining liquid to the temperature control flow channel 22. The temperature control flow channel 22 is configured by a circular opening that extends in the width direction of the die coater 12. As the temperature maintaining liquid, for example, water, oil, or the like may be used.

The decompression chamber 50 is provided on the upstream side of the die coater 12. So as to stabilize a state of the bead, which is formed between the web and the die coater 12, of the coating liquid, the decompression chamber 50 maintains a pressure state in the vicinity of the bead in an ideal state.

The container 40 including the guide plate 40*a* is fixed in the vicinity of the lip face 18 of the upstream die block 20*a*. The container 40 is fixed to the upstream die block 20*a* at a portion of the guide plate 40*a* through an elastic body 46 using a screw 60. In this embodiment, a head portion of the screw 60 does not substantially protrude from the guide plate 40*a* of the container 40. It is preferable that the screw 60 be formed from a material, for example, a solvent resistant resin such as New Light, PEEK, and PPS, an anticorrosion metal such as SUS304 and SUS316, or the like.

As the elastic body 46, for example, nitrile rubber (NBR), kalrez (registered trademark) (fluorine-based rubber), or the like is used. When the container 40 is fixed through the elastic body 46, the elastic body 46 functions as a seal member. Accordingly, it is possible to prevent a solvent from entering between the container 40 and the upstream die block 20*a*.

Furthermore, a caulking material 52 is provided to an upper end of the container 40 in order for the coating liquid or solvent ejected from the die coater 12 not to enter between the container 40 and the upstream die block 20*a*. As the caulking material 52, a solvent-resistant caulking material such as Perflon paint (two-liquid mixed type) or the like may be used.

The container 40 extends beyond the upstream die block 20*a* to the decompression chamber 50 that is located on a further lower position than the upstream die block 20*a*.

A lower end portion of the container 40 has a U-shaped configuration, and the entirety of the container 40 has an approximately J-shaped configuration. The container 40 collects the coating liquid or solvent that flows along the guide plate 40*a*. A liquid discharge tube 48 is connected to the container 40 so as to discharge the collected coating liquid or solvent to the outside.

In a non-steady state, in which the coating liquid is not supplied from the die coater 12 to the web, the container 40 collects the coating liquid or solvent that is ejected from the slot 16 of the die coater 12 without bringing the coating liquid or solvent to come into contact with the mount 30 and the decompression chamber 50.

The non-steady state is a state in which the coating liquid or solvent is ejected from the die coater 12. That is, the non-steady state is a state other than the steady state in which the coating liquid is supplied to the web.

Examples of the non-steady state include 1) a state in which the solvent is made to flow from the die coater 12 so as to avoid trapping of air bubbles into the manifold 14 of the die coater 12 while the die coater 12 is detached from the web, and, 2) a state in which the die coater is made to recede from the web while ejecting the coating liquid when a joint portion at which webs are jointed approaches the die coater 12, and the like.

Since the coating liquid or solvent does not come into contact with the mount 30 and the decompression chamber 50, evaporation latent heat of the coating liquid or solvent does not have an effect on the mount 30 and the decompression chamber 50. Therefore, the mount 30 and the decompression chamber 50 are not thermally deformed, and deformation of the die coater 12 may be suppressed.

The container 40 is thermally deformed due to the evaporation latent heat. However, the container 40 does not physically come into contact with the mount 30 and the decompression chamber 50, the thermal deformation of the container 40 is not transmitted to the mount 30 and the decompression chamber 50.

The container 40 and the die coater 12 are physically connected to each other. Since the temperature control flow channel 22 is formed in the die coater 12, the temperature of the container 40 is also substantially controlled. Therefore, the thermal deformation of the container 40 may be suppressed.

It is preferable that the lowest end of the container 40 and the screw 60 (first attachment unit) of the container 40 be spaced from each other at an interval of 80 mm or more. When a distance is left between the lowest end of the container 40 and the attachment unit of the container 40, the rigidity of the container 40 is lowered. Therefore, even in a case where the container 40 is thermally deformed, deformation of the die coater 12 may be further suppressed.

In addition, it is preferable that the container 40 be spaced from the mount 30 and an inner wall of the decompression chamber 50 at an interval of 0.5 mm or more. The reason why the interval of 0.5 mm or more is left is to make an effect of heat transmission between the container 40 and the mount 30 and the decompression chamber 50 small and to make workability of assembly easy.

Furthermore, it is preferable that the container 40 be formed from a member having average rigidity of 20,000 (N/(m·k)) or less. As a material of the container 40, an anticorrosion metal such as SUS304 and SUS316, a solvent resistant resin such as New Light (ultra-high molecular weight polyethylene), PEEK, and PPS, or the like may be used.

Figure 7A:
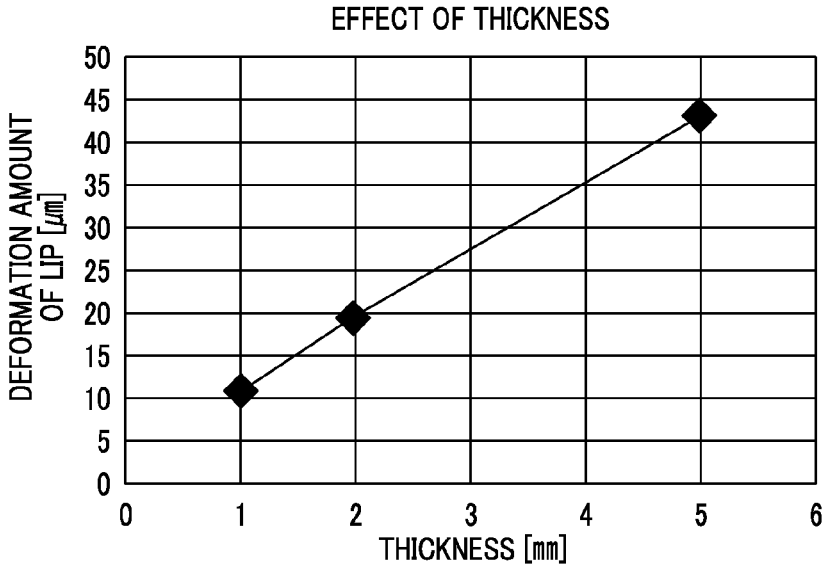
FIG. 7A is a graph illustrating a relationship between a deformation amount of a lip on the tip of a die coater and a thickness of a container.
Figure 7B:
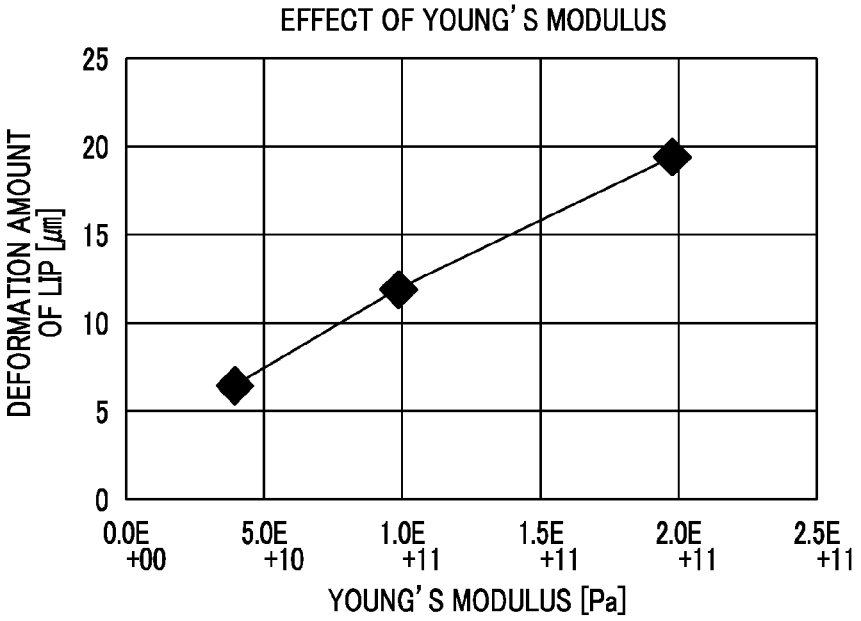
FIG. 7B is a graph illustrating a relationship between the deformation amount of the lip of on the tip of the die coater and Young's modulus of the container.
Figure 7C:
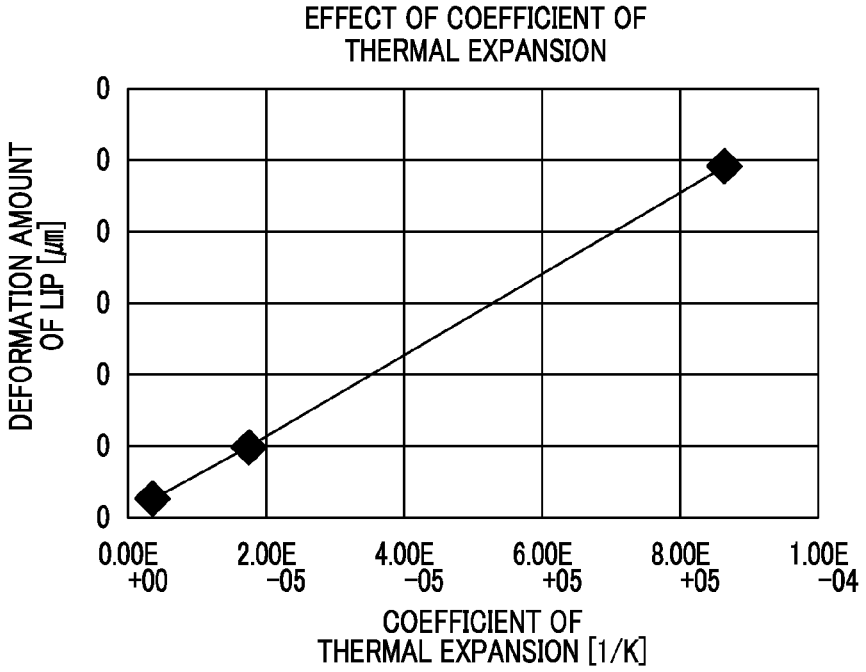
FIG. 7C is a graph illustrating a relationship between the deformation amount of the lip on the tip of the die coater and coefficient of thermal expansion of the container.

Here, the average rigidity is an average value of thickness× Young's modulus×coefficient of thermal expansion in a width direction. This value is obtained by performing thermal deformation analysis of the entirety of the die coater using FEM (Finite Element Method) simulation. FIG. 7A illustrates a relationship between a deformation amount of a lip on the tip of the die coater and a thickness of the container. FIG. 7B illustrates a relationship between the deformation amount of the lip on the tip of the die coater and Young's modulus of the container. FIG. 7C illustrates a relationship between the deformation amount of the lip on the tip of the die coater and coefficient of thermal expansion of the container.

As shown in FIGS. 7A to 7C, the thickness, the Young's modulus, and the coefficient of thermal expansion of the container are proportional to the deformation amount of the lip on the tip of the die coater. The present inventors found that when the thickness, the Young's modulus, and the coefficient of thermal expansion of the container are set to have a predetermined relationship, the deformation amount of the lip on the tip of the die coater is suppressed. In addition, the present inventors examined the deformation amount of the lip on the tip of the die coater, and found that when thickness×Young's modulus×coefficient of thermal expansion is set to an average rigidity of 20,000 (N/(m·k)) or less, the deformation amount of the lip on the tip of the die coater may be suppressed to 20 μm or less.

Figure 2:
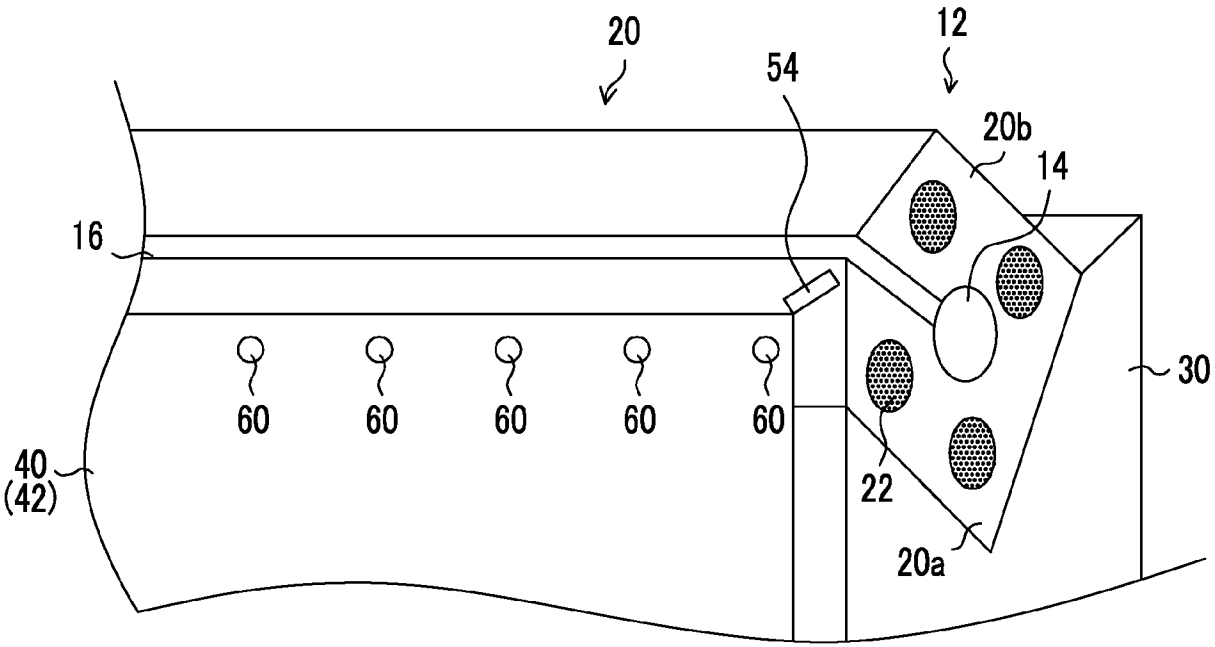
FIG. 2 is a perspective diagram of the coating apparatus according to the first embodiment.

FIG. 2 shows a perspective diagram of the coating apparatus 10. The decompression chamber 50 is not shown in this drawing. The container 40 is attached to the upstream die block 20*a* along a width direction of the die coater 12 by the screw 60. The length of the container 40 in the width direction is shorter than the length of the die coater 12 in the width direction. It is preferable that a guide member 54 be provided on a container 40 attaching surface of the upstream die block 20*a* toward the container 40 so as to guide the coating liquid or solvent ejected from the die coater 12 to the container 40. The guide member 54 may be either a groove, or a convex portion which has a width of 0.1 mm or more and a height of 0.1 mm or more.

It is preferable that the interval between adjacent screws 60 be set to 30 mm or more. When the interval between the adjacent screws 60 is left, deformation of the die coater 12 that is caused by the thermal deformation of the container 40 may be further suppressed.

Second Embodiment

Figure 3:
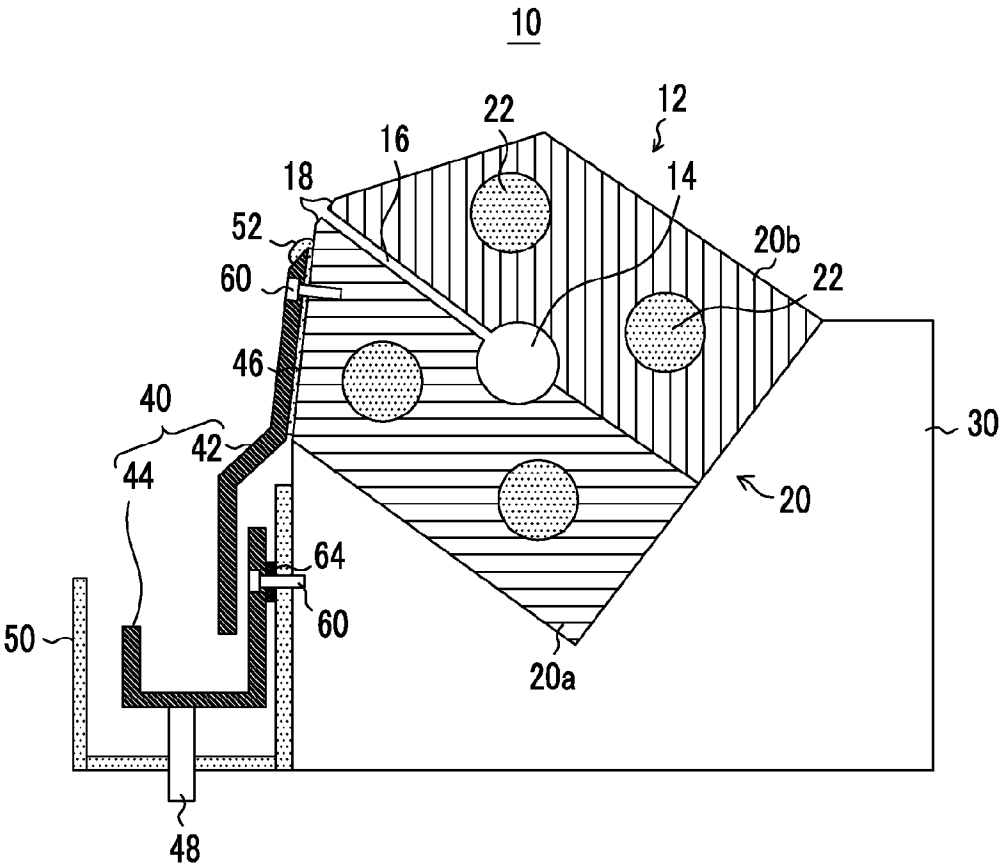
FIG. 3 is a schematic configuration diagram of a coating apparatus according to a second embodiment.

FIG. 3 shows a cross-sectional diagram of a coating apparatus. The coating apparatus 10 includes an extrusion-type die coater 12, a mount 30 that supports the die coater 12, a container 40 that is attached to the die coater 12, and a decompression chamber 50 that is provided to be adjacent to the die coater 12. In this embodiment, differently from the first embodiment, the container 40 is configured by a guide plate member 42 and a container member 44. The guide plate member 42 and the container member 44 are not physically coupled to each other, or are coupled only at one place although not shown. Since the guide plate member 42 and the container member 44 are not physically coupled to each other, or are coupled only at one place, rigidity of the entirety of the container 40 is not high. Even in a case where the container 40 is thermally deformed, deformation of the die coater 12 may be further suppressed.

In addition, the same reference numeral are given to substantially the same parts as those of the first embodiment, and description thereof may be omitted.

The guide plate member 42 is fixed to an upstream die block 20*a* by a screw 60 through an elastic body 46 in the vicinity of a lip face 18. In this embodiment, a head portion of the screw 60 does not substantially protrude from the guide plate member 42.

A caulking material 52 is provided to an upper end of the guide plate member 42 in order for the coating liquid or solvent ejected from the die coater 12 not to enter between the guide plate member 42 and the upstream die block 20*a*.

The guide plate member 42 extends beyond the upstream die block 20*a* to the decompression chamber 50 that is located on a further lower position than the upstream die block 20*a*. The container member 44 is provided at a lower position than the guide plate member 42. The container member 44 collects the coating liquid or solvent that flows along the guide plate member 42. The container member 44 has an approximately U-shaped configuration or an approximately J-shaped configuration so as to collect the coating liquid or solvent. A liquid discharge tube 48 is connected to the container member 44 so as to discharge the collected coating liquid or solvent to the outside. The container member 44 is fixed to the decompression chamber 50 by the screw 60 through a spacer 64. It is preferable that the spacer 64 be formed from an anticorrosion metal such as SUS304 and SUS316, a solvent resistant resin such as New Light (ultra-high molecular weight polyethylene), PEEK, and PPS, or the like.

In an non-steady state, in which the coating liquid is not supplied from the die coater 12 to the web, the container 40 configured by the guide plate member 42 and the container member 44 collects the coating liquid or solvent that is ejected from the slot 16 of the die coater 12 without bringing the coating liquid or solvent to come into contact with the mount 30 and the decompression chamber 50.

Since the coating liquid or solvent does not come into contact with the mount 30 and the decompression chamber 50, evaporation latent heat of the coating liquid or solvent does not have an effect on the mount 30 and the decompression chamber 50. Therefore, the mount 30 and the decompression chamber 50 are not thermally deformed, and deformation of the die coater 12 may be suppressed.

The guide plate member 42 and the container member 44 are thermally deformed due to evaporation latent heat. The guide plate member 42 and the die coater 12 are physically connected to each other. Since a temperature control flow channel 22 is formed in the die coater 12, the temperature of the guide plate member 42 is also substantially controlled. Therefore, the thermal deformation of the guide plate member 42 may be suppressed.

The container member 44 and the decompression chamber 50 are physically connected to each other. However, as described later, the container member 44 is formed from a material having relatively low rigidity. Even in a case where the container member 44 is thermally deformed, stress thereof is weak, and thus the decompression chamber 50 is not deformed due to this stress.

It is preferable that the lowest end of the container member 44 and the screw 60 (third attachment unit) of the container member 44 be spaced from each other at an interval of 80 mm or more. When a distance is left between the lowest end of the container member 44 and the attachment unit of the container member 44, the rigidity of the container member 44 is lowered. Therefore, even in a case where the container 40 is thermally deformed, deformation of the die coater 12 may be further suppressed.

In addition, it is preferable that the container member 44 be disposed to be spaced from an inner wall of the decompression chamber 50 at an interval of 0.5 mm or more. The reason why the interval of 0.5 mm or more is left is to make an effect of heat transmission between the container member 44 and the decompression chamber 50 small and to make workability of assembly easy.

Furthermore, it is preferable that the guide plate member 42 and the container member 44 be formed from a member having average rigidity of 20,000 (N/(m·k)) or less. As a material of the guide plate member 42 and the container member 44, an anticorrosion metal such as SUS304 and SUS316, a solvent resistant resin such as New Light (ultra-high molecular weight polyethylene), PEEK, and PPS, or the like may be used.

When the average rigidity of the guide plate member 42 and the container member 44 is set to 20,000 (N/(m·k)) or less, a deformation amount of the lip on the tip of the die coater may be suppressed to 20 μm or less.

It is preferable that an interval between adjacent screws 60 (second attachment units) that fix the guide plate member 42 be set to 30 mm or more. When the interval between the adjacent screws 60 is left, deformation of the die coater 12 that is caused by the thermal deformation of the guide plate member 42 may be further suppressed.

Similarly, it is preferable that an interval between adjacent screws 60 that fix the container member 44 be set to 30 mm or more. When the interval between the adjacent screws 60 is left, deformation of the decompression chamber 50 that is caused by the thermal deformation of the container member 44 may be suppressed. As a result, the deformation of the die coater 12 that is caused by the deformation of the decompression chamber 50 may be further suppressed.

It is preferable that the lowest end of the guide plate member 42 be located at a lower position than the adjacent screws 60 that fix the container member 44. This is in order for the coating liquid or solvent that flows along the guide plate member 42 and is dropped therefrom not to enter between the container member 44 and the decompression chamber 50.

Similarly to the first embodiment, it is preferable that a guide member 54 be provided on a guide plate member 42 attaching surface of the upstream die block 20*a* toward the guide plate member 42 so as to guide the coating liquid or solvent ejected from the die coater 12 to the guide plate member 42. The guide member 54 may be either a groove, or a convex portion which has a height of 0.1 mm or more (FIG. 2).

Figure 4A:
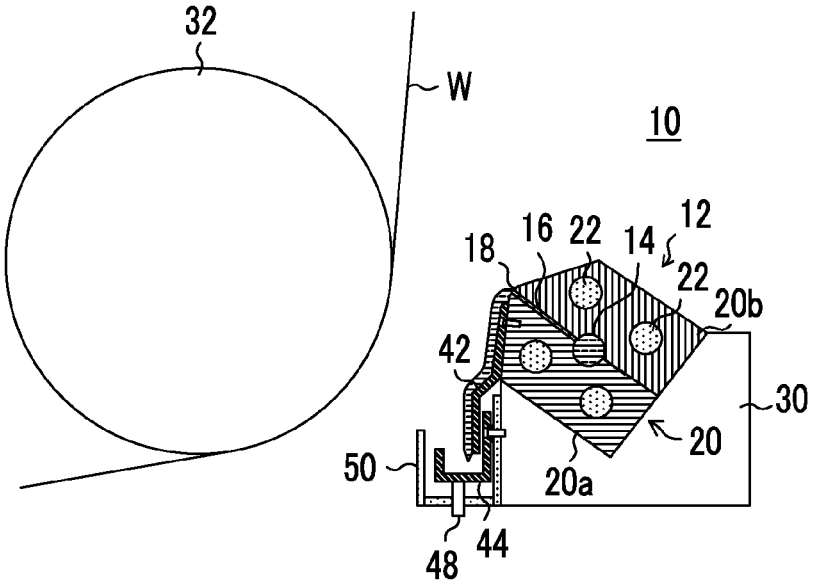
FIGS. 4A and 4B are schematic diagrams illustrating a method of manufacturing a coated film.
Figure 4B:
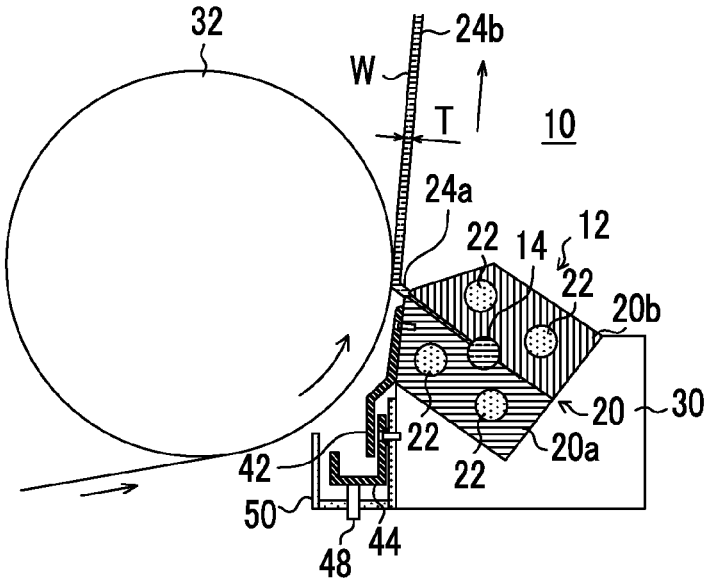

Next, a method of manufacturing a coated film using the coating apparatus 10 of the second embodiment will be described with reference to FIGS. 4A and 4B.

The coating apparatus 10 is provided to the mount 30. The mount 30 is made to move close to or away from the web W by a moving unit (not shown), that is, the mount moves back and forth. A clearance between the web W and the coating apparatus 10 is adjusted by the moving unit.

In a case where performing a coating process using the coating apparatus 10, preparation work before the coating is performed so as to stabilize the supply of the coating liquid. The coating apparatus 10 is provided with respect to the web Win such a manner that a clearance between the web W and the coating apparatus 10 in the preparation work before coating, that is, in the non-steady state, is wider than a clearance kept during coating. In the non-steady state, the solvent is ejected from the die coater 12 so as to discharge air bubbles inside the manifold 14. The solvent, which is supplied from the lip face 18, passes through the upstream die block 20*a* and reaches the guide plate member 42. The solvent flows along the guide plate member 42 to the lower end thereof. The solvent is collected by the container member 44 and is discharged through the liquid discharge tube 48 (FIG. 4A).

After the preparation before coating is completed, the coating apparatus 10 is made to move forward until the clearance between the coating apparatus and the web W supported by a backup roller 32 becomes a predetermined clearance, for example, 0.03 to 0.15 mm. The movement means relative movement, and the web W may be made to approach the coating apparatus 10. The web W is conveyed in a velocity of 20 m/minute or more. The solvent may be switched to the coating liquid, and thus the die coater 12 coats the continuously traveling web W with the coating liquid as a bead 24*a*. Accordingly, a coating film 24*b* having a wet film thickness T of 10 μm or less is formed on the web W (FIG. 4B).

The non-steady state in the coating preparation was described, but the above may be applied to an non-steady state accompanied with the passing of a joint portion.

Figure 5:
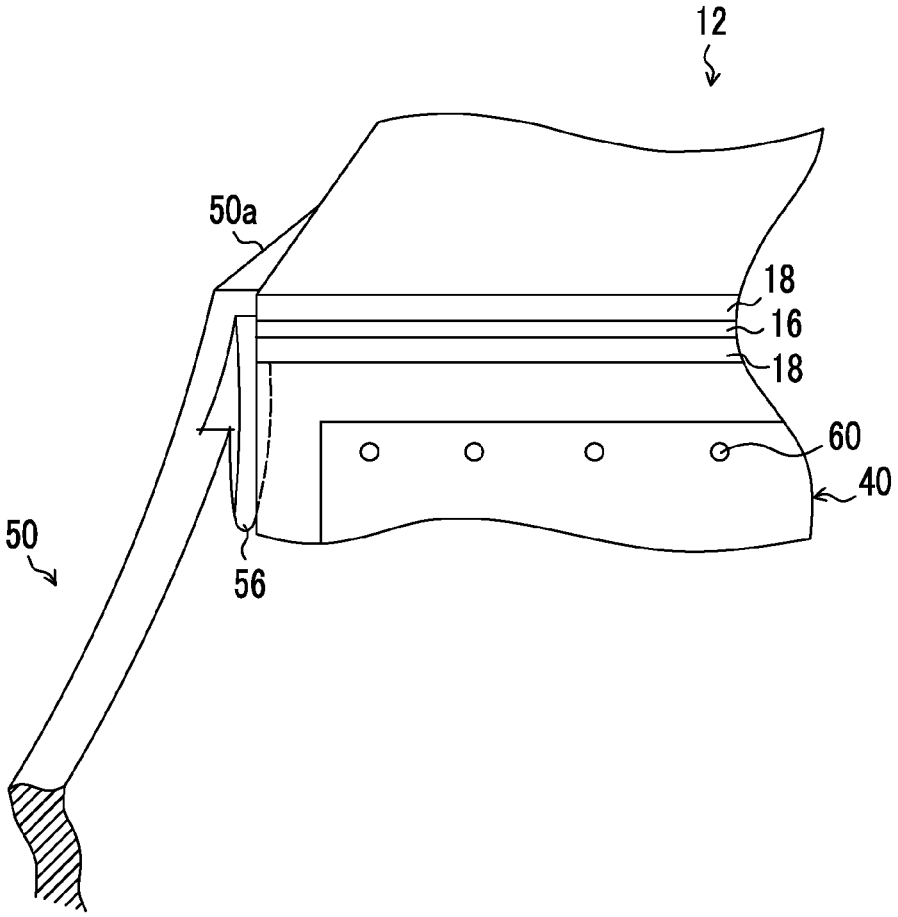
FIG. 5 is an explanatory diagram illustrating a positional relationship between a die coater and a side plate of a decompression chamber.

Next, a positional relationship between the die coater and a side plate of the decompression chamber will be described with reference to FIG. 5. The decompression chamber 50 includes two sheets of side plates 50*a* and a back plate (not shown) that is connected to the two sheets of side plates 50*a*. The side plates 50*a* are disposed to substantially come into contact with an end portion of the die coater 12. The back plate is disposed at a position that is opposite to the die coater 12.

A recess 56 is formed in a surface, which corresponds to the slot 16, of each of the side plates 50*a*. For example, the side plate 50*a* has the thickness t of 10 mm, and the recess 56 has the depth d of approximately 0.1 mm. Since the depth of the recess 56 is smaller that the thickness of the side plate 50*a*, the recess 56 does not penetrate through the side plates 50*a*. Therefore, the pressure inside the decompression chamber is maintained by the side plates 50*a*.

A predetermined distance is formed between the slot 16 and the side plate 50*a* due to the recess 56. Even when outflow of the coating liquid from the slot 16 occurs, the coating liquid does not reach the side plates 50*a*. That is, since the coating liquid does not come into contact with the decompression chamber 50, thermal deformation of the decompression chamber 50 may be suppressed.

As the coating liquid that is applied to the web W, an organic solvent coating liquid which needs to be applied with low viscosity and a small thickness may be appropriately used, such as a coating liquid for an optical compensation film, a coating liquid for a antireflection film, and a coating liquid for viewing angle enlargement. For example, methyl ethyl ketone or the like is used.

As the web W, various known webs may be used. In general, examples of the web W include various known plastic films such as polyethylene terephthalate, polyethylene-2,6-naphthalate, cellulose diacetate, cellulose triacetate, cellulose acetate propionate, polyvinyl chloride, polyvinylidene chloride, polycarbonate, polyimide, and polyamide; paper; various laminated sheets obtained by applying or laminating α-olefins having 2 to 10 carbon atoms such as polyethylene, polypropylene, and ethylene butene copolymer to the paper; webs obtained by forming a preliminary processing layer on the surface of a striped-shaped base such as a metal foil of aluminum, copper, tin, or the like; and various composite materials obtained by laminating these.

Figure 6:
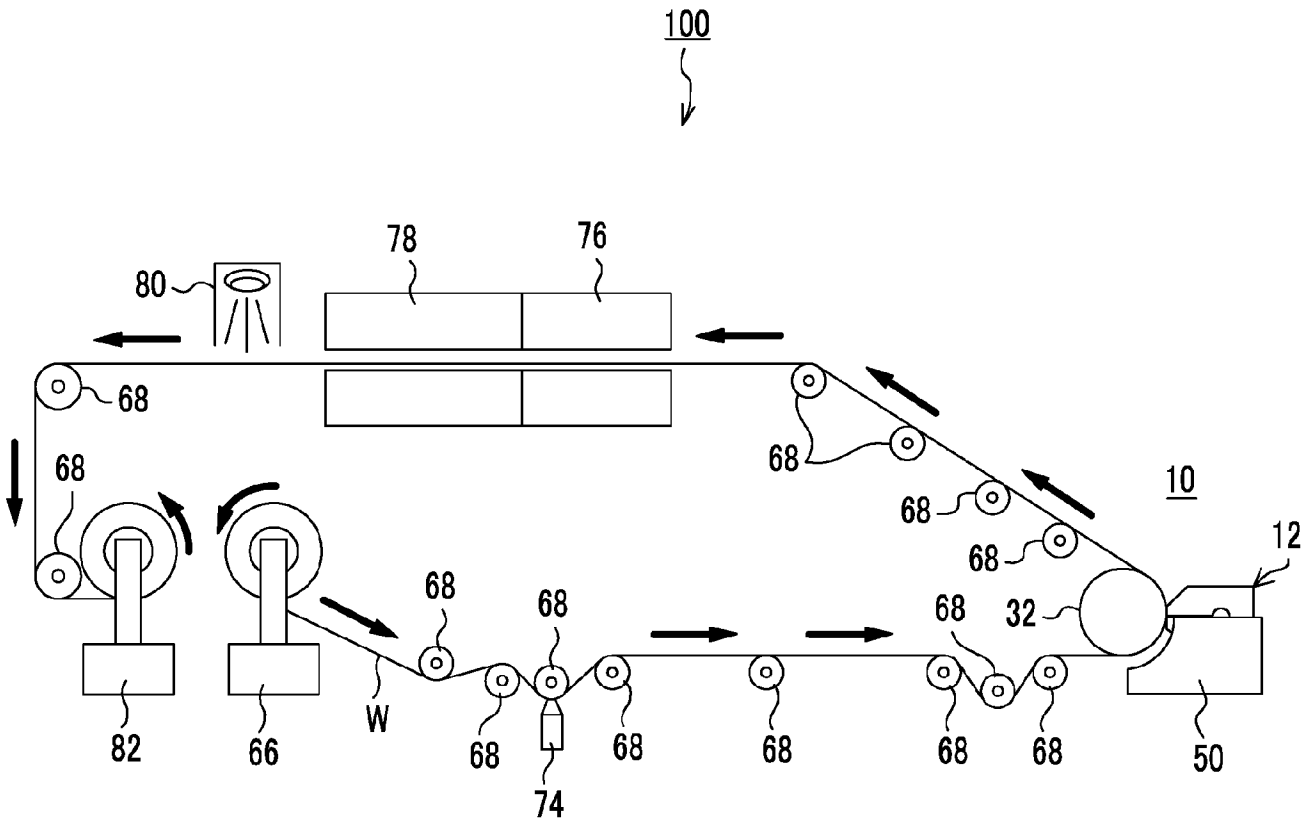
FIG. 6 is a configuration diagram illustrating a manufacturing line of an optical film.

FIG. 6 shows a diagram illustrating a manufacturing line of an optical film that is a coated film. An arrow in the drawing represents a traveling direction of the web W. In addition, in regard to plural pass rollers 68 that convey the web W, only pass rollers 68 that are disposed at representative positions are shown.

In the manufacturing line 100 of this embodiment, a transmitter 66, a dust remover 74, a backup roller 32, the coating apparatus 10, a drying device 76, a heating device 78, an ultraviolet irradiation device 80, and a winder 82 are sequentially provided from the upstream side to the downstream side. The coating apparatus 10 may be either the coating apparatus related to the first embodiment or the coating apparatus related to the second embodiment.

The transmitter 66 sequentially transmits the web W that is a transparent support body on which a polymer layer is formed in advance to the downstream side. The dust remover 74 removes foreign matter, such as dust, that adheres to the web W.

The coating liquid is ejected from the die coater 12 toward the web W that is conveyed and supported by the backup roller 32 to form a coating film on the web W. The decompression chamber 50 is disposed upstream of the die coater 12. The decompression chamber 50 includes two sheets of side plates and the back plate. Because decompression is performed by the decompression chamber 50, a bead may be formed with high degree of precision.

The drying device 76 and the heating device 78 make up a zone in which the coating film formed on the web W is dried. The drying device 76 evaporates the solvent contained in the coating film. The heating device 78 may be used to heat the web W as necessary so as to remove a solvent or harden the film.

In addition, it is preferable that the drying of the solvent by the drying device 76 and the heating device 78 be performed in a state of being covered with a cover. Rectified wind, homogeneous wind, or the like may be used as drying wind. The evaporated solvent may be condensed and removed by a cold condensing plate that is provided to be opposite to the coating film surface.

The ultraviolet irradiation device 80 emits ultraviolet rays to the coating film by an ultraviolet ramp. A monomer or the like of the coating film is cross-linked by the ultraviolet rays and a desired polymer is formed. The winder 82 winds and collects the web W on which the polymerized coating film is laminated in a roll shape.

In addition, a heating zone at which the coating film is hardened by heat may be further provided depending on components of the coating film to perform hardening and crosslinking of the desired coating film. In addition, in other processes than the manufacturing line 100, other treatments such as a heating treatment may be performed with respect to the coating film on the web W.

Plural pass rollers 68 are provided between the respective units. The web W is transmitted from an upstream side to a downstream side by these pass rollers 68. The position and the number of the pass rollers 68, a distance between rotation centers of the pass roller 68 adjacent to each other, and the like may be appropriately adjusted according to necessity.

In addition, the backup roller 32 and the pass rollers 68 function as a guide roller that conveys the web W. In addition, other units may be provided to the manufacturing line 100 as necessary. For example, in regard to the optical compensation film, a rubbing treatment device that adjusts an orientation of a liquid crystal portion of a coating film may be provided in front of or behind the dust remover 74.

What is claimed is:

1. A coating apparatus comprising:

a die coater that supplies a coating liquid to a web which is continuously travelling, the die coater including a die main body, a manifold into which the coating liquid is supplied and which is formed in the die main body, a slot from which the coating liquid is ejected and which is formed in the die main body and communicating with the manifold, and a lip face formed in the die main body at a tip of the slot;

a mount that supports the die coater;

a decompression chamber that is disposed upstream of the die coater in a web conveyance direction;

a container that includes a guide plate guiding the coating liquid or a solvent ejected from the slot of the die coater, the container collecting the coating liquid or the solvent guided by the guide plate, without bringing the coating liquid or solvent into contact with the mount and the decompression chamber while the coating liquid or the solvent is ejected from the slot in a state where the die coater is positioned apart from the web with a predetermined clearance therebetween, the predetermined clearance being larger than a clearance which is kept between the die coater and the web while the coating liquid is supplied to the web from the die coater; and a liquid discharge tube that is connected to the container and discharges the coating liquid or solvent to an outside of the decompression chamber, wherein the container including the guide plate is integrally formed, and the container is attached to the die main body by a plurality of attachment units along a width direction of the web, and an average distance between the attachment units and a lowest end portion of the container is 80 mm or more.

2. The coating apparatus according to claim 1, wherein the container is formed of a member having an average rigidity of equal to or less than 20,000 (N/(m·k)), where the average rigidity is defined as an average value of {thickness×Young's modulus×coefficient of thermal expansion} in a width direction.

3. The coating apparatus according to claim 1, wherein the container is disposed as being spaced apart from the mount and the decompression chamber by a distance of 0.5 mm or more.

4. The coating apparatus according to claim 1, wherein the container is attached to the die main body through an elastic body.

5. The coating apparatus according to claim 1, wherein a caulking material is provided at an upper end of the container, the caulking material being configured to cover a gap between the container and the die main body.

6. The coating apparatus according to claim 1, wherein the attachment units that are adjacent to each other are disposed to be spaced from each other at an interval of 30 mm or more.

7. The coating apparatus according to claim 1, wherein a groove or a convex portion is formed on a container attaching surface of the die main body, the groove or the convex portion being configured to guide the coating liquid or solvent ejected from the slot to the container.

8. The coating apparatus according to claim 1, wherein the decompression chamber includes two sheets of arc-shaped side plates and a back plate that is connected to the two sheets of side plates, and a distance between the side plates and the lip face of the die coater is set to 0.1 mm or more.

9. A coating apparatus comprising:

a die coater that supplies a coating liquid to a web which is continuously travelling, the die coater including a die main body, a manifold into which the coating liquid is supplied and which is formed in the die main body, a slot from which the coating liquid is ejected and which is formed in the die main body and communicating with the manifold, and a lip face formed in the die main body at a tip of the slot;

a mount that supports the die coater;

a decompression chamber that is disposed upstream of the die coater in a web conveyance direction;

a container that includes a guide plate guiding the coating liquid or a solvent ejected from the slot of the die coater, the container collecting the coating liquid or the solvent guided by the guide plate, without bringing the coating liquid or solvent into contact with the mount and the decompression chamber while the coating liquid or the solvent is ejected from the slot in a state where the die coater is positioned apart from the web with a predetermined clearance therebetween, the predetermined clearance being larger than a clearance which is kept between the die coater and the web while the coating liquid is supplied to the web from the die coater; and a liquid discharge tube that is connected to the container and discharges the coating liquid or solvent to an outside of the decompression chamber, wherein the container including the guide plate is configured by a guide plate member and a container member, the guide plate member is attached to the die main body by a plurality of attachment units along a width direction of the web, and the container member is attached to the decompression chamber or the mount by a plurality of attachment units along a width direction of the web, and an average distance between the plurality of attachment units, by which the container member is attached to the decompression chamber or the mount, and a lowest end portion of the container member is 80 mm or more.

10. The coating apparatus according to claim 9, wherein the container member is formed of a member having an average rigidity of equal to or less than 20,000 (N/(m·k)) where the average rigidity is defined as an average value of {thickness×Young's modulus×coefficient of thermal expansion} in a width direction.

11. The coating apparatus according to claim 9, wherein the container member is disposed as being spaced apart from the mount and the decompression chamber by a distance of 0.5 mm or more.

12. The coating apparatus according to claim 9, wherein the guide plate member is attached to the die main body through an elastic body.

13. The coating apparatus according to claim 9, wherein a caulking material is provided at an upper end of the container, the caulking material being configured to cover a gap between the guide plate member and the die main body.

14. The coating apparatus according to claim 9, wherein the attachment units, by which the container member is attached to the decompression chamber or the mount, that are adjacent to each other are disposed to be spaced from each other at an interval of 30 mm or more, and the attachment units, by which the guide plate member is attached to the die main body, that are adjacent to each other are disposed to be spaced from each other at an interval of 30 mm or more.

15. The coating apparatus according to claim 9, wherein the guide plate member and the container member are physically separated from each other or are coupled to each other at one place.

16. The coating apparatus according to claim 9, wherein a groove or a convex portion is formed on a container attaching surface of the die main body, the groove or the convex portion being configured to cover a gap between the guide plate member and the die main body.

17. The coating apparatus according to claim 9, wherein a lowest end of the guide plate member is located at a lower position compared to the attachment units, by which the container member is attached to the decompression chamber or the mount.

* * * * *